US005226064A

United States Patent [19]

Yahata et al.

[11] Patent Number: 5,226,064

[45] Date of Patent: Jul. 6, 1993

[54] COMPUTERIZED TOMOGRAPHIC SCANNING APPARATUS DRIVEN BY RECHARGEABLE BATTERIES

[75] Inventors: Mitsuru Yahata; Shigeru Tanaka, both of Ootawara, Japan

[73] Assignee: Kabushiki Kaisha Toshiba, Kawasaki, Japan

[21] Appl. No.: 908,545

[22] Filed: Jun. 30, 1992

Related U.S. Application Data

[63] Continuation of Ser. No. 701,025, May 16, 1991, abandoned.

[30] Foreign Application Priority Data

May 17, 1990 [JP] Japan ..... 2-125330

[51] Int. Cl.[5] ..... H05G 1/10

[52] U.S. Cl. ..... 378/4; 378/101; 378/102; 378/103

[58] Field of Search ..... 378/4, 15, 16, 19, 20, 378/101, 102, 103, 114, 115, 104–107

[56] References Cited

U.S. PATENT DOCUMENTS 4,797,907 1/1989 Anderton ..... 378/101

4,928,283 5/1990 Gordon ..... 378/11

*Primary Examiner*—David P. Porta

*Attorney, Agent, or Firm*—Oblon, Spivak, McClelland, Maier & Neustadt

[57] ABSTRACT

In a CT (computerized tomographic) scanning apparatus, a biological body under medical examination is scanned to acquire image data on the scanned body, whereby a computerized tomographic image of the scanned body is reconstructed by processing the acquired image data. The CT scanning apparatus comprises: an AC/DC converting unit for converting AC (alternating current) power supplied from a commercial power source into first DC (direct current) power; a peak power consumption unit for consuming peak power during a scanning operation; and a secondary battery unit rechargeable by the first DC power supplied from the AC/DC converting unit and capable of supplying second DC power to the peak power consumption unit during at least the scanning operation.

11 Claims, 5 Drawing Sheets

COMPUTERIZED TOMOGRAPHIC SCANNING APPARATUS DRIVEN BY RECHARGEABLE BATTERIES

This application is a continuation of application Ser. No. 07/701,025, filed on May 6, 1991, now abandoned.

BACKGROUND OF THE INVENTION

1. Field of the Invention

The present invention generally relates to a CT (computerized tomographic) scanning apparatus selectively driven by a DC power source and an AC power source. More specifically, the present invention is directed to a CT scanner temporarily driven by secondary (rechargeable) batteries during scanning operation.

2. Description of the Related Art

As is known in the CT scanner field, power supply facilities installed in CT scanners such as an X-ray CT (computerized tomographic) imaging apparatus, normally and directly supply high power that is received from a commercial power supply, e.g., a three-phase power supply, to a high-power consumption low unit thereof. This high-power consumption load unit includes an X-ray tube driving unit, a gantry driving unit, and a couch driving unit. These driving units excluding the couch driving unit require high or peak power while scanning a biological body under medial examination laid on the couch.

Under such circumstances, the power supply facilities of the conventional CT scanners must be designed to have high power capacities in order that peak power (e.g., 30 kW) required during the scanning operation is available, which is extremely higher than the power required the non-scanning operation, for instance, ten to several tens times higher than the normal power (e.g., 3 kW). In other words, the power supply facilities of the conventional CT scanners can sufficiently supply such peak power to the high power consumption unit during at least the scanning operation.

As a result, since the conventional power supply facilities must be designed to allow peak power, or high power capacities, such conventional power supply facilities become very expensive. For instance, the rated power of the power cables must be designed to withstand such peak power. Moreover, to maintain such high-power consumption facilities, higher expense must be paid to power supply firms.

There are further problems in the conventional high power facilities in view of total efficiencies of the power supply facilities. For instance, assuming now that the typical operation time period of one conventional CT scanner is about 8 hours in one day and 200 scanning operations are to be performed within eight operation-hours, since one scanning operation practically requires approximately 3 seconds, the entire scanning operation in one day requires only approximately 600 seconds (i.e., 10 minutes). That is, such high peak power is required only for 10 minutes, namely 1/48 ($=10/8\times60$) of the entire operation time per day. Nevertheless, the conventional power supply facilities must have high power capacities capable of supplying such peak power.

SUMMARY OF THE INVENTION

The present invention has been made in an attempt to solve the above-described problems, and therefore has an object to provide a computerized tomographic scanning apparatus including a secondary battery unit capable of supplying high peak power to a higher power consumption unit thereof during at least scanning operation.

Another object of the present invention is to provide a computerized tomographic scanning apparatus equipped with a power supply facility having a rechargeable battery unit, which is sufficiently operable even by a power supply facility having a very small power capacity.

To achieve the above-described objects and other features, a computerized tomographic scanning apparatus, according to the present invention, for scanning a biological body under medical examination to acquire image data on the scanned body, whereby a computerized tomographic image of the scanned body is reconstructed by processing the acquired image data, comprises:

AC/DC converting means (2) for converting AC (alternating current) power supplied from a commercial power source (1) into first DC (direct current) power;

peak power consumption means (3) for consuming peak power during a scanning operation; and secondary battery means (5) rechargeable by said first DC power supplied from the AC/DC converting means (2) and capable of supplying second DC power to the peak power consumption means (3) during at least the scanning operation.

BRIEF DESCRIPTION OF THE DRAWINGS

For a better understanding of the present invention, reference is made of reading the following description in conjunction with the accompanying drawings, in which.

DETAILED DESCRIPTION OF THE PREFERRED EMBODIMENTS

Arrangement of Power Supply Facility for First CT Scanning Apparatus

Figure 1:
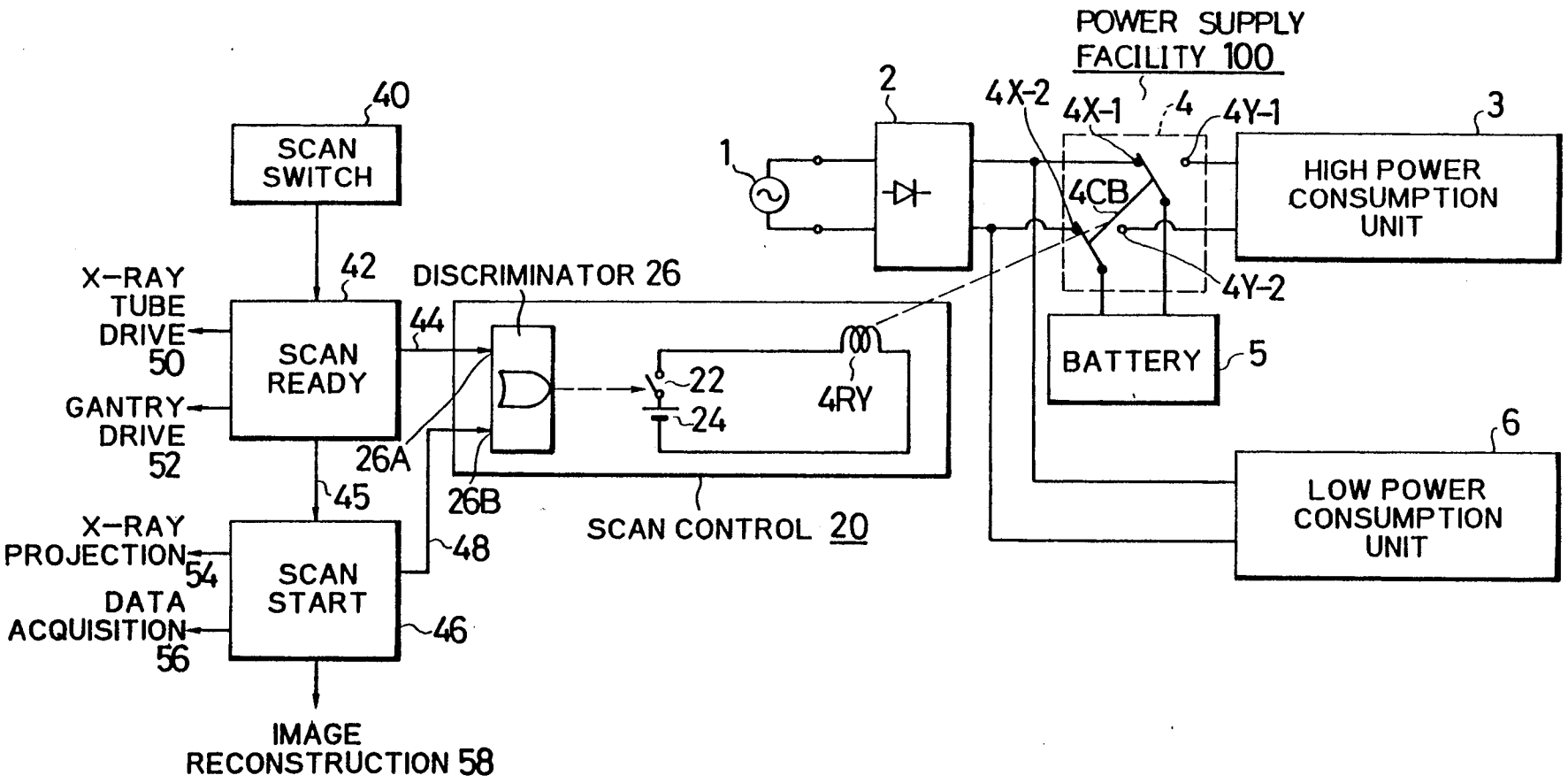
FIG. 1 is a schematic block diagram for showing a power supply facility 100 of a CT scanning apparatus according to a first preferred embodiment of the present invention.

Referring now to FIG. 1, a description will be made of a circuit arrangement of a power supply facility 100 installed in a CT (computerized tomographic) scanning apparatus according to a first preferred embodiment of the present invention.

The first power supply facility 100, shown in FIG. 1, is constructed of: a rectifier circuit 2 connected to a commercial power supply source 1; a high power consumption unit 3 (simply referred to as a "first load unit") connected to a DC output of the rectifier circuit 2, a low power consumption unit 6 (simply referred to as a "second load unit") also connected to the DC output of the rectifier circuit 2; a secondary (rechargeable) battery unit 5; a switching unit 4; and also a scan control unit 20. As apparent from this circuit diagram of FIG. 1, the switching unit 4 is connected in such a manner that the DC power outputted from the rectifier circuit 2 is continuously supplied to the low power consumption unit 3, and is selectively supplied to recharge, the secondary battery unit 5 through switching contacts 4X-1;4Y-1 and 4X-2;4Y-2 under switching control of the scan control 20 (will be discussed more in detail).

It should be noted that the high power consumption unit 3 includes, for instance, an X-ray tube drive unit 50 (not shown in detail) and a gantry drive unit 52 (not shown either), whereas the low power consumption unit 6 includes, for instance, an X-ray data acquisition unit 56 (not shown) and an image reconstruction unit 58 (not shown). That is, the high power consumption unit 3 requires high power during the scanning operation, whereas the lower power consumption unit 6 requires continuously constant power not depending upon the scanning/non-scanning operations. Under such circumstances, the low power consumption unit 6 is directly connected to the DC output of the rectifier unit 2, whereas the high power consumption unit 3 is connected to the secondary battery unit 5 only during the scanning operation.

Scan Control Unit

Since the above-described switching operation under control of the scan control unit 20 constitutes a major feature of the power supply facility 100 according to the first preferred embodiment, an internal arrangement of the scan control unit 20 will now be described more in detail.

The scan control unit 20 is constructed of a relay coil 4RY having a relay contact blade 4CB and the above-described four contacts 4X-1, 4X-2, 4Y-1, 4Y-2; a switch 22; a DC cell 24; and a signal discriminator 26 having a first input 26A and a second input 26B. As apparent from FIG. 1, these relay coil 4RY, contact blade 4CB, and four contacts 4X-1, 4X-2, 4Y-1, 4Y-2 constitute the switching unit 4. When the switch 22 is turned ON (closed), this relay coil 4RY is energized by the cell 24 so that the contact blade 4CB is changed from the contacts 4X-1, 4X-2 to the contact 4Y-1, 4Y-2. Accordingly, the high power consumption unit 3 is connected via these relay contacts 4Y-1, 4Y-2 to the secondary battery unit 5.

The above-described relay switching control is performed by the signal discriminator 26 in accordance with the following manner.

When a scan starting switch 40 is operated, a scan ready unit 42 is brought into an operation state so that the X-ray tube drive unit 50 and the gantry drive unit 52 are brought into standby conditions, for instance, a filament of an X-ray tube (not shown in detail) starts to be heated, and also a scan ready signal 44 is produced and supplied to the first input 26A of the discriminator 26. Since this discriminator 26 is constructed of, for example, an OR gate, upon receipt of this scan ready signal 44 the discriminator 26 causes the switch 22 to be turned ON. As a result, the relay coil 4RY is energized, whereby the recharging operation of the secondary battery unit 5 by the rectifier unit 2 is interrupted and then the DC power is supplied from this battery unit 5 to the high power consumption unit 3 for preparing the scanning operation.

After the scan ready signal 44 was produced and a predetermined time period has passed, an instruction signal 45 is furnished from this scan ready unit 42 to a scan start unit 46. In response to this instruction signal 45, the scan start unit 46 enables the X-ray projection unit 54, data acquisition unit 56 and image reconstruction unit 58 to be under operation condition, and also produces a scan start signal 48. This scan start signal 48 is supplied to the second input 26B of the discriminator 26.

It should be understood that when the scan start signal 48 is supplied to the second input 26B of the discriminator 26, the scan ready signal 44 is no longer supplied to the first input 26A thereof, and this scan start signal 48 is continued to be supplied to the second input 26B of the discriminator 26 during the scanning operation. Therefore, the switch unit 4 is continued to be switched into the battery power supply operation. Namely, the high power consumption unit 3 is continuously energized by the DC power supplied from the secondary battery unit 5 while turning ON the relay coil 4RY during the scanning operation.

When the scanning operation is accomplished, no scan start signal is longer supplied to the discriminator 26 so that the relay coil 4RY is turned OFF (opened), because neither the scan ready signal 44 nor the scan start signal 48 is supplied to this discriminator 26, e.g., OR gate.

Figure 2:
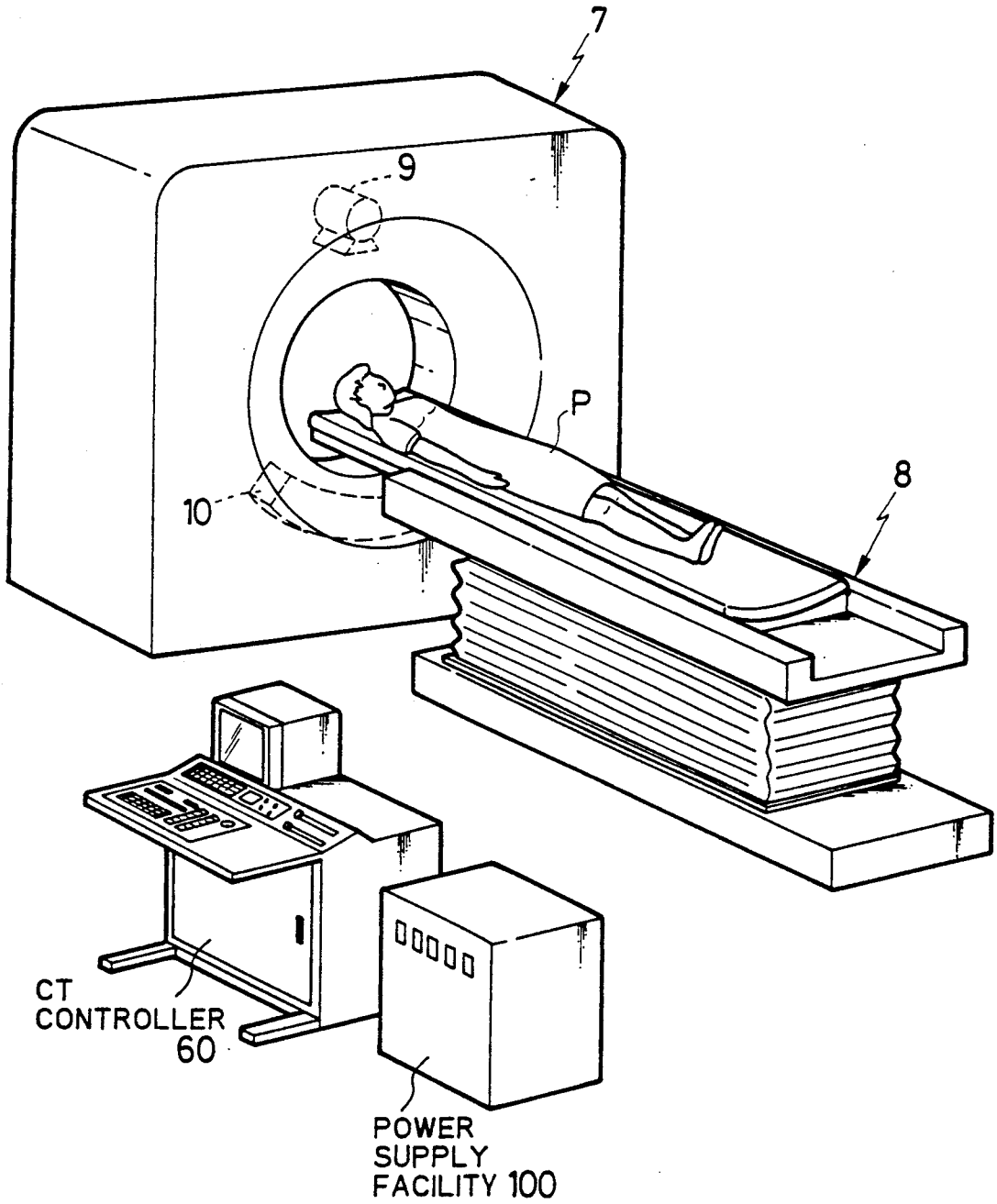
FIG. 2 is a perspective view of the CT scanning apparatus 100 equipped with the first power supply facility shown in FIG. 1.

FIG. 2 illustrates how to assemble the above-described the first power supply facility 100 with the X-ray CT scanning apparatus.

As is known, this X-ray CT scanning apparatus is mainly constructed of a gantry 7 and a couch 8 also driven by the gantry drive unit 52 (not shown in detail); an X-ray tube 9 and an X-ray detector 10 which are rotated around a biological body "p" under medical examination. Furthermore, the X-ray projection unit 54, and image reconstruction unit 58 are employed in a CT controller 60, whereas the data acquisition unit 56 is employed in the gantry 7.

Second Power Supply Facility

Figure 3:
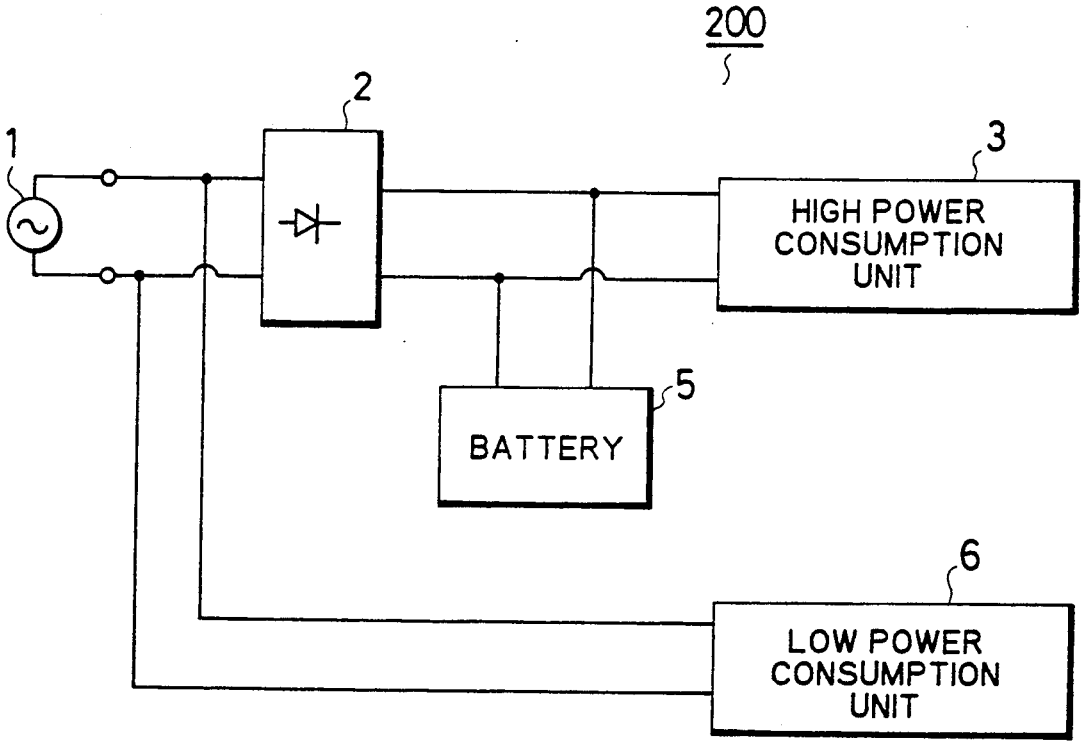
FIG. 3 is a schematic block diagram of a power supply facility 200 according to a second preferred embodiment of the present invention.

Referring now to FIG. 3, a circuit arrangement of a power supply facility 200 according to a second preferred embodiment of the present invention will be described.

It should be noted that the same reference numerals shown in FIG. 1 will be employed as those for denoting the same circuit elements shown in the following figures.

In the circuit diagram of the second power supply facility 200, both the secondary battery unit 5 and the first load unit, namely high power consumption unit 3 are directly connected to the output of the rectifier circuit 2. Also, the second load unit, namely low power consumption unit 6 is directly connected to the commercial power source 1.

When the scanning operation is carried out, the DC output derived from the rectifier circuit 2 is superimposed with the DC power supplied from the secondary battery unit 5 and then supplied to the high power consumption unit 3.

Advantages ot the First and Second Power Supply Facilities

There are various particular advantage in the above-described first and second power supply facilities 100 and 200.

First, the capacity of the commercial power source 1 may be considerably lowered, as compared with that of the conventional power source. That is, since the peak power required for the high power consumption unit 3 can be supplied from either the secondary battery unit 5, or both this battery unit 5, and the rectifier circuit 2, the commercial power source 1 needs not supply such peak power during the scanning operation, and therefore may have such a power capacity capable of supplying the average power required in the high power consumption unit 3.

This particular advantage will now be described more in detail. For instance, assuming now that the scanning times are 200 scans per one day and 1 scanning time period is 3 seconds, these scanning operations are performed for only 600 seconds in total within a day. Assuming also that the apparatus operation hour is 8 hours, the peak power for the scanning operation is required only for 600 seconds, i.e., 10 minutes.

As a consequence, the time period requiring the peak power becomes only approximately 2% of the entire operation time period of the scanning apparatus (namely, 10 min./ (10+470) min.).

In general, the typical peak power is selected to be approximately 30 KW when the X-ray output is about 24 KW (120 KV×200 mA) in the typical X-ray scanning apparatus with the medium or small X-ray power output.

Assuming now that the peak power required for the scanning operation is about 10 times higher than the power required for the non-scanning (waiting) operation, the average power is approximately 1.2 times higher than the power required for the non-scanning operation, i.e., $(10\times10+1\times470)/480=1.2$ approximately. Accordingly, according to the above-described first and second preferred embodiments, the power capacity of the commercial power source 1 can be considerably reduced, i.e., $1.2/10=1/8$ approximately lower than that of the commercial power source. As a consequence, the rated capacities of the power cables may be lowered. Moreover, the cost of the commercial power source 1 may be greatly reduced and also the dimension thereof may be made compact.

Furthermore, since a single rechargeable battery having a DC voltage of 110 V and a DC current of 180 A is commercially available, the secondary battery unit 5 is capable of supplying DC power (300 V×120 A) to the high power consumption unit 3 only during the scanning operation for approximately 3 seconds.

It should be noted that the low power consumption load unit 6 may be connected to the output of the rectifier unit.

Third Power Supply Facility

Figure 4:
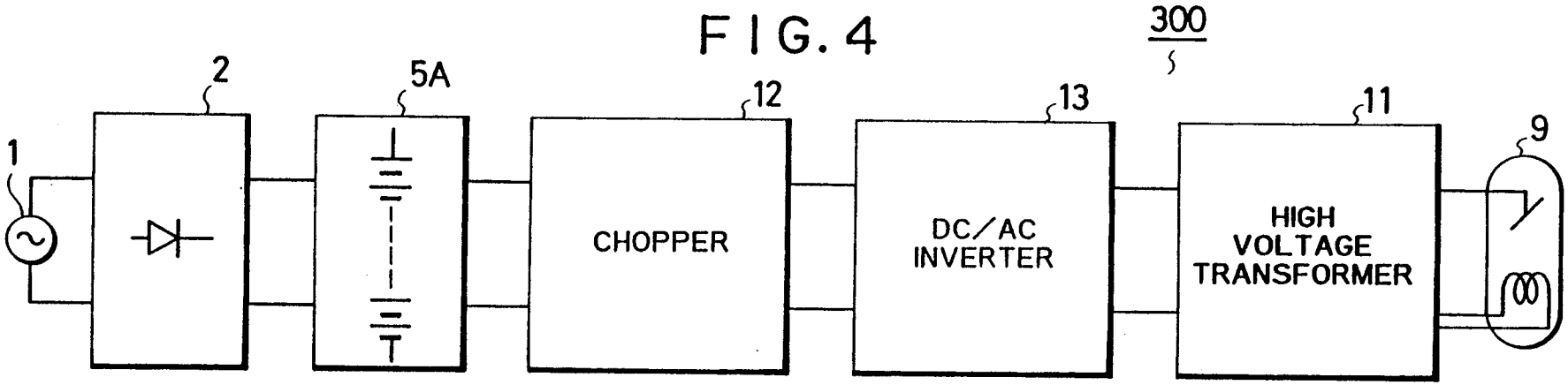
FIG. 4 is a schematic block diagram of a power supply facility 300 according to a third preferred embodiment of the present invention.
Figure 6:
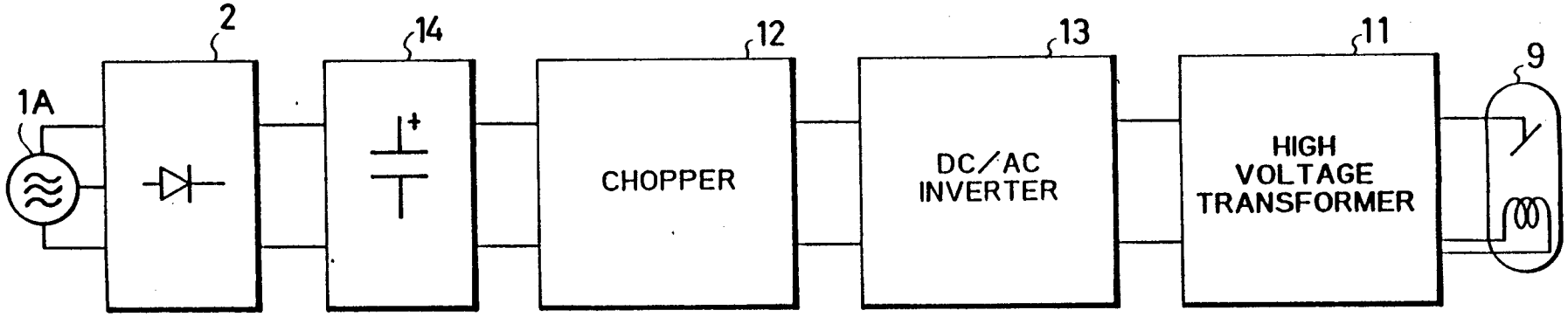
PRIOR ART FIG.6
FIG. 6 is a schematic block diagram of the conventional power supply facility.

FIG. 4 is a block diagram of a power supply facility 300 for generating an X-ray high voltage in an X-ray CT scanning apparatus according to a third preferred embodiment of the present invention, and FIG. 6 is a block diagram of the conventional power supply facility for generating an X-ray high voltage.

As apparent from these circuit diagrams shown in FIG. 4 and 6, a filtering capacitor unit 14 is replaced by a secondary battery unit 5A and a three-phase commercial power source 1A is substituted by the single-phase commercial power source 1 in the third power supply facility 300.

In this third power supply facility 300, the secondary battery unit 5A is employed as the major power supply source to a high voltage transformer 11 via a chopper circuit 12 and a DC/AC inventer 13. As a result, the high DC power may be supplied from the secondary battery unit 5A during the scanning operation, and this secondary battery unit 5A is charged from the single-phase commercial power source 1 during the non-scanning operation. Also, an X-ray tube 9 may be sufficiently driven by this battery unit 5A during the scanning operation.

There is another particular advantage in the third power supply facility 300. When the X-ray CT scanning apparatus is operated in a so-called "scan-and-view" mode, namely a scan rest time is maintained during the overall scanning operation (will be discussed later), the secondary battery unit 5A may be charged during this scan rest time and may supply DC power which has been so far charged therein, to the high voltage transformer 11. Therefore, the X-ray CT scanning system may be realized with higher power utilization.

Figure 5:
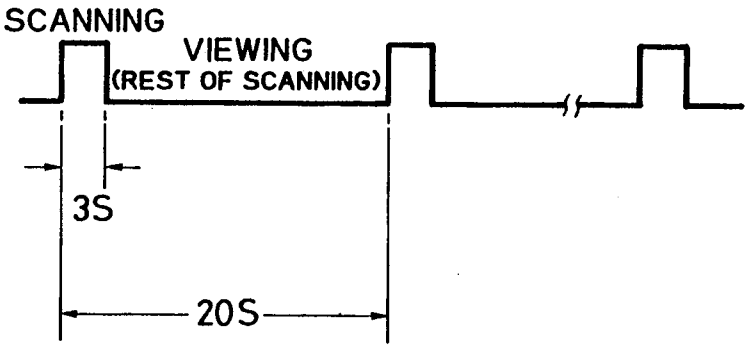
FIG. 5 is an illustration for explaining a so-called "scan and view" operation effected in the CT scanning apparatus shown in FIG. 2.

For instance, as shown in a FIG. 5, assuming now that the scanning time is 3 seconds and the minimum scanning interval is 20 seconds, total power may be constructed by 3/20 power and normal power, so that the power capacity of the third power supply facility 300 may be reduced to approximately 1/7 (=3/20).

For a better understanding of this particular advantage, the following comparison is made:

When the scanning cycle as defined in FIG. 5 is employed, assuming now that, the scanning conditions are set to 120 KV and 200 mA in the conventional power supply facility shown in FIG. 6, the total power is given by:

$$120\ KV\times200\ mA\ /\ 0.7=34\ \text{KVA},$$

where 0.7 indicates an efficiency.

To the contrary, when the third power supply facility 300 is employed, the total power is given as follows:

$$34\ KVA\times3/20=5\ KVA$$

In other words, the power capacity of the commercial power source 1 employed in the third power supply facility 300 may be considerably reduced to the small capacity, i.e., 5 KVA, as compared with the large capacity (namely 34 KVA) of the conventional power source 1A.

Although the above-described preferred embodiments are realized in the X-ray CT scanning apparatuses, the present inventive idea is not limited to the X-ray CT scanners, but not only to other CT scanners such as MR imaging system, but also X-ray diagnostic apparatus.

As previously described, in the CT scanning apparatus according to the present invention, since the secondary battery unit is employed so as to supply the higher power to the load unit with the high power consumption during the scanning operation, the power capacity of the commercial power supply source may be considerably reduced and also the power cable capacity may be selected to be small values. As a consequence, the compact CT scanning apparatus may be manufactured at lower cost.

What is claimed is:

1. A computerized tomographic scanning apparatus for scanning a biological body under medical examination to acquire image data on the scanned body, whereby a computerized tomographic image of the scanned body is reconstructed by processing the acquired image data, comprising:

AC/DC converting means for converting AC (alternating current) power supplied from a commercial power source into first DC (direct current) power;

peak power consumption means for consuming peak power during a scanning operation;

secondary batter means rechargeable by said first DC power supplied from the AC/DC converting means and capable of supplying second DC power to the peak power consumption means during at least the scanning operation;

scan control means for producing at least a scan control signal in response to a commencement of the scanning operation; and selecting means for selecting electric connections among the AC/DC converting means, peak power consumption means, and secondary battery means in response to the scan control signal in such a manner that the second DC power is supplied from the secondary battery means to peak power consumption means during at least the scanning operation, said scan control means including at least switching means for turning ON/OFF said selecting means, and a discriminator for discriminating whether or not the scanning operation commences to produce said scan control signal, and said distributor receiving a scan start signal, whereby discrimination is made whether or not the scanning operation starts in response to the scan start signal.

2. A CT scanning apparatus as claimed in claim 1, further comprising:

lower power consumption means directly, connected to the commercial power source, whereby the lower power consumption means receives only AC power therefrom.

3. A CT scanning apparatus as claimed in claim 2, wherein said lower power consumption means includes data acquisition means and image reconstruction means.

4. A CT scanning apparatus as claimed in claim 1, wherein said AC/DC converting means is constructed of rectifier means.

5. A CT scanning apparatus as claimed in claim 1, wherein both the peak power consumption means and secondary battery means are directly connected parallel to an output of the AC/DC converting means, both the first DC power from the AC/DC converting means and the second DC power from the secondary battery means are simultaneously supplied to the peak power consumption means during at least the scanning operation.

6. A CT scanning apparatus as claimed in claim 1, wherein said peak power consumption means includes X-ray tube drive means.

7. A CT scanning apparatus as claimed in claim 6, wherein said peak power consumption means further includes gantry drive means.

8. A CT scanning apparatus as claimed in claim 1, further comprising:

low power consumption means continuously connected to an output of the AC/DC converting means, whereby the lower power consumption means receives only said first DC power therefrom.

9. A CT scanning apparatus as claimed in claim 8, wherein said lower power consumption means includes data acquisition means and image reconstruction means.

10. An X-ray diagnostic apparatus for medically examining a biological body under medical examination to acquire medical image information of the examined bódy, comprising:

AC/DC converting means for converting AC (alternating current) power supplied from a commercial power source into first DC (direct current) power;

X-ray generating means for generating and scanning X-ray beams over the biological body so as to medically examiner the biological body; and secondary battery means rechargeable by said first DC power supplied from the AC/DC converting means during a time period inbetween successive X-ray scanning operations, and capable of intermittently supplying second DC power to the X-ray generating means, said X-ray generating means including:

a DC/AC inverter unit for inverting said second DC power supplied from the secondary battery means into second AC power;

a high voltage transformer unit for transforming said second AC power derived from the DC/AC inverter unit to produce a high DC voltage; and an X-ray tube for generating the X-ray beams by receiving said high DC voltage applied from the high voltage transformer unit.

11. An X-ray diagnostic apparatus as claimed in claim 10, further comprising:

a chopper unit interposed between said secondary battery unit and said DC/AC inverter unit, for chopping said second DC power supplied from the secondary battery unit to obtain chopped DC power which is supplied to said DC/AC inverter.

* * * * *